US006193147B1

(12) United States Patent
Schluger

(10) Patent No.: US 6,193,147 B1
(45) Date of Patent: Feb. 27, 2001

(54) FOLDER FOR LETTER-SIZE DOCUMENTS

(76) Inventor: Allen Schluger, 21 W. 68th St., New York, NY (US) 10023

( * ) Notice: Subject to any disclaimer, the term of this patent is extended or adjusted under 35 U.S.C. 154(b) by 0 days.

(21) Appl. No.: 09/503,290

(22) Filed: Feb. 14, 2000

(51) Int. Cl.[7] ..... B65D 27/00
(52) U.S. Cl. ..... 229/67.3; 229/67.4; 229/72
(58) Field of Search ..... 229/67.1, 67.2, 229/67.3, 67.4, 72, 87.03, 87.15, 87.16, 87.17, 87.18, 87.19, 928

(56) References Cited

U.S. PATENT DOCUMENTS

| | | | | |
|---|---|---|---|---|
| 847,648 | * | 3/1907 | Carnahan | 229/67.1 |
| 930,837 | * | 8/1909 | Bushnell, Jr. | 229/67.3 |
| 2,364,297 | * | 12/1944 | James | 229/87.19 |
| 3,236,439 | * | 2/1966 | Johnson et al. | 229/72 |
| 3,294,312 | * | 12/1966 | Mullins | 383/2 X |
| 3,933,294 | * | 1/1976 | Meenan et al. | 229/67.3 |
| 4,109,850 | * | 8/1978 | Meenan et al. | 229/67.3 X |
| 4,149,667 | * | 4/1979 | Riley | 229/72 |
| 4,221,161 | * | 9/1980 | Hurt | 229/72 X |
| 4,436,202 | * | 3/1984 | Berkley | 229/72 X |
| 4,893,745 | * | 1/1990 | Weber et al. | 229/72 X |

* cited by examiner

*Primary Examiner*—Jes F. Pascua
(74) *Attorney, Agent, or Firm*—Myron Amer PC

(57) ABSTRACT

A folder of a type opened in presenting 8 ½ by 11 inch documents to a business associate or other interested party, in which a side and bottom edge of the documents are previously manually inserted into cooperating isosceles triangles along the side and bottom of the folder, the manual insertion being to the extent of wedging the thickness of the documents along the side and bottom edges into a gripping engagement with the progressively diminishing clearance between the converging sides of the isosceles triangles, to the end of maintaining a neat appearance in the folder both prior to and in the subsequent presentation of the documents.

1 Claim, 1 Drawing Sheet

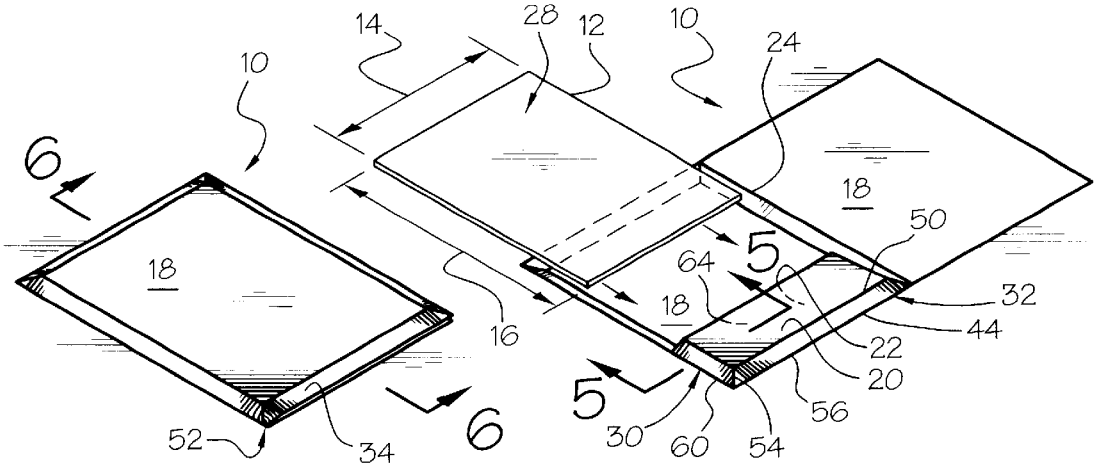
FIG. 1
FIG. 2
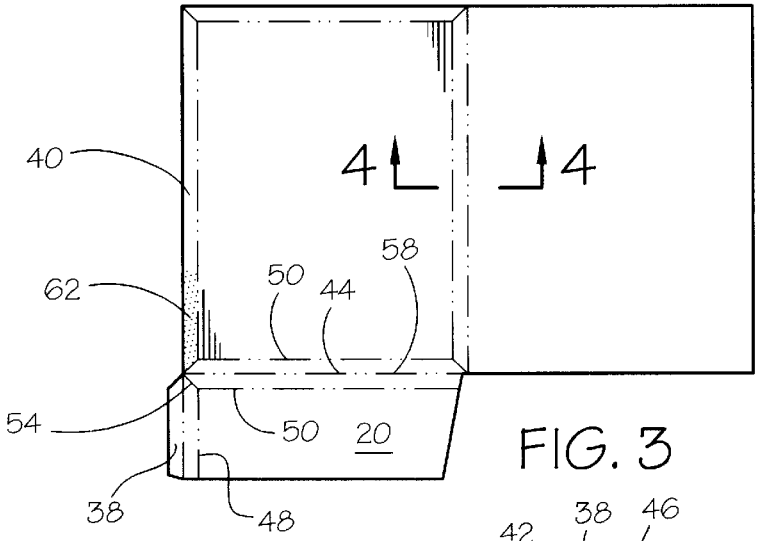
FIG. 3
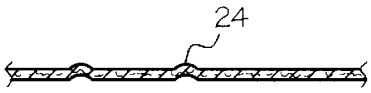
FIG. 4
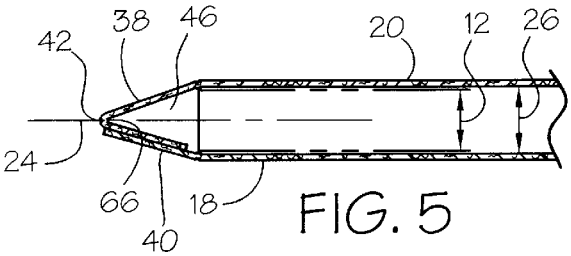
FIG. 5
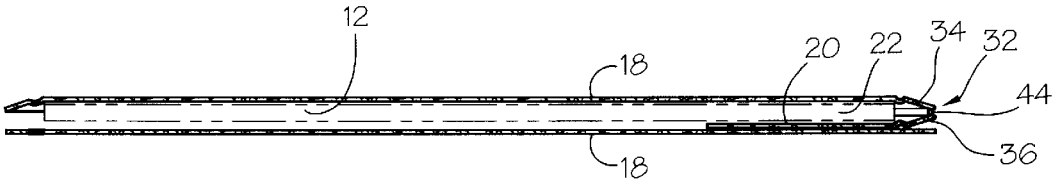
FIG. 6

FOLDER FOR LETTER-SIZE DOCUMENTS

The present invention relates generally to improvements in so-called presentation folders in the use of which, as the name implies, commercial documents, typically 8½ by 11 inches, are "presented" by the opening of a front cover of the folder for inspection by an individual having a business interest in the documents, and wherein, more particularly, the improvements impart a neat appearance to the folder even before being opened and likewise during the contents presentation, to contribute to invoking a favorable response on the inspecting individual.

BACKGROUND OF THE INVENTION

Field of the Invention

It is known from common experience that an envelope and/or a folder, the latter item being specifically involved, should have a neat appearance in order to make a good impression, and that this appearance is mainly the manner in which it maintains, or conversely, does not maintain its shape, or the parallelism of its front cover and rear panel. Maintaining a neat appearance is a more demanding requirement when the contents of the envelope/folder varies in number, so that the thickness or bulk is variable and to be accommodated there must be a front cover and rear panel separation.

This problem is addressed in the prior art by the use of gussets. More particularly, the use of unfolding gussets in envelopes to increase the size thereof is well known as exemplified by U.S. Pat. 3,063,618 issued to E. B. Berkowitz for "Expanding Envelope" on Nov. 13, 1962 and U.S. Pat. No. 768,340 issued to W. W. Ormsbee, Jr. for "Envelope" on Aug. 23, 1904. The gussets in the aforesaid are positioned initially inwardly of the envelope and, in such position, interfere with the insertion of commercial literature into the envelope.

Gussets that initially are projected outwardly of the body of the envelope and unfold inwardly towards the body solve the problem noted in connection with the '618 and '340 patented envelopes, and are embodied in U.S. Pat. No. 4,549,688 issued to Ozmon et al. for "Expandable File Folder" on Oct. 29, 1985. But if the two halves of the V shape which define the gusset in the '688 patent do not fully unfold, i.e., only partially unfold, there is absent an edge, which would be the fully unfolded gusset, to hold the contents in place and to prevent slippage of some documents from the stack of documents from a medial location to a position adjacent the outboard edge of the gusset.

SUMMARY OF THE INVENTION

Broadly, it is an object of the present invention to provide a gusseted presentation folder overcoming the foregoing and other shortcomings of the prior art.

More particularly, it is an object to embody isosceles triangle-shaped gussets in the folder which effectively grip a side and bottom edge of the document assemblage in the folder, to thus hold the assemblage in place which correspondingly maintains its rectangular shape, its front cover and rear panel in parallel relation with each other and other appearance-enhancing attributes.

BRIEF DESCRIPTION OF THE DRAWING

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view geneally of an exemplary known folder, but modified in accordance with the present invention;

FIG. 2 is a view similar to FIG. 1 and illustrating details of the structural modifications of the folder;

FIG. 3 is a plan view of a cardboard blank used in the construction of the folder;

FIG. 4 is a cross sectional view taken along line 4—4 of FIG. 3;

FIG. 5 is a cross sectional view taken along line 5—5 of FIG. 2; and FIG. 6 is a cross sectional view taken along lines 6—6 of FIG. 1.

DESCRIPTION OF THE PREFERRED EMBODIMENT

It is already well known to use a folder of cardboard construction material, generally designated 10 to store, preparatory to dissemination an assemblage 12 of documents, each of letter size, i.e., a width 14 of 8½ "and a length 16 of 11" in the folder 10 having a single left, or right, 8½ by 11 inch rear panel 18 and in facing relation therewith a partial, or full, front panel 20, such that between the front and rear panels 20 and 18 there exists a storage compartment 22 for the assemblage 12. The assemblage 12 typically is comprised of plural 8½ by 11 inch documents in number divided equally on opposite sides of a vertical medial plane 24 thus constituting a thickness 26 of the assemblage 12. In prior art use of the just described folder 10 the inserted assemblage 12 in the compartment 22 often experiences slippage of documents so that, although the 11 inch dimension 16 is maintained, the width dimension 14 typically increases from 8½ inches to possibly 10 or 11 inches, thus providing an undesirable appearance to the assemblage 12. This shortcoming is particularly troublesome if the assemblage 12 is stored preparatory to dissemination, since the unattractive appearance that is viewed when the folder 10 is opened does not make a good impression on the viewer.

In accordance with the present invention the foregoing and other shortcomings of the prior art are overcome by holding the inserted assemblage 12 in an 8½ by 11 inch rectangular configuration 28, i.e., with each document stacked directly upon the other and no slippage therebetween. To this end, use is made of two cooperating laterally extending and depending pairs 30 and 32 of gripping panels 34 and 36, of depending pair 32 and gripping panels 38 and 40 of lateral pair 30. The gripping panels 34 and 36 and of 38 and 40, have an outboard fold 42 and 44 respectively so that each said pair 30, 32 is adapted to unfold into an isosceles triangular shape 46, the utility of which will be better understood as the description proceeds.

The gripping panels pair 30 have two inboard fold lines, as at 48, as does the gripping panels pair 32, as at 50, and in assembly at a left corner 52 of the folder 10 the pairs 30, 32 interconnect each other in a miter joint-type fold line 54. The inboard fold lines 48 and 50 are integral respectively to the bottom edge 56 of the front panel 20 and the bottom edge 58 of the rear panel 18. In somewhat similar fashion, the inboard fold lines 48 and 50 are integral to the left side edge 60 of the front panel 20, and panel 46 has an adhesive coating on a rear surface 62, as viewed from the perspective of FIG. 5, and thus when in contact with a border along the edge of the rear panel 18 serves as a glue flap assembling the front 20 and rear panels 18 to each other to bound therebetween the previously noted compartment 22.

When the assemblage 12 is inserted into the compartment 22 through an appropriate access opening, in this case located at 64, its thickness 26 will cause an unfolding of the panel pairs 30 and 32 into isosceles triangle configurations 46. During insertion, the user is instructed to use moderate manual force to provide positioning of the left and bottom edges 60 and 58 of the assemblage respectively into the isosceles triangle configurations 46. Since the distance between the sides or panels 34 and 36, and of the sides or panels 38 and 40 respectively forming the isosceles triangles 46 diminish in the direction of the apex 66 of the triangles 46, there is by necessity, since the assemblage thickness 26 remains constant, an extent or distance of insertion at which the panels 38 and 40 grip the left edge of the assemblage 60 and the panels 34 and 36 grip the bottom edge 58. It has been found in practice that the gripping which occurs, as at 68 and 70, obviates document slippage as might undesirably increase the assemblage width 14 greater than 8½ inches, to correspondingly detract from the appearance of the folder 10 and of its document contents 12.

Stated somewhat differently, the vertical plane of the outboard fold lines 42 and 44 are coincident with left and bottom edges of the assemblage vertical medial plane 24 so that the front and rear panels 20 and 18 in their positions of clearance from each are correspondingly maintained in parallel relation to each other which contribute to a desirable neat appearance in the folder 10.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination an assemblage of 8½inch by 1 inch contents having a thickness delimited by opposite sides of a medial flat plane of said assemblage, and a folder comprising two cooperating pairs of gripping panels of cardboard construction material, each said pair of gripping panels having an outboard fold line coincident with an edge of said folder and two inboard fold lines, one said inboard fold line being on a partial front panel of said folder and the other on a rear panel of said folder, said outboard and inboard fold lines cooperating to bound two isosceles triangles, one said triangle being along a side edge of said folder and the other along a bottom edge thereof, said assemblage having an operative position inserted between said partial front panel and rear panel of said folder with said thickness of a side edge and bottom edge thereof each wedged into a said cooperating isosceles triangle in the direction of said triangle apex to an extent at which said thickness of said assemblage exceeds a clearance dimension between opposite sides of said isosceles triangle to thereby cause a gripping of said assemblage side and bottom edges, a full-sized 8½ inch by 11 inch folder front panel adapted to be assembled to said folder rear panel an isosceles triangle configuration connected in an interposed position between said full-sized front panel and said rear panel to allow closing movement of said full-sized front panel upon said partial front panel while maintaining in an expansion of said isosceles triangular configuration said assemblage medial plane in parallel relation to said partial front panel and rear panel, and a miter joint at an intersection of said side edge and said bottom edge of said two pairs of gripping panels, whereby said parallel relation of said full-sized folder front and rear panels and said miter joints cooperate to contribute to a neat appearance of said folder.

* * * * *